United States Patent [19]

Stephens

[11] 4,362,484

[45] Dec. 7, 1982

[54] APPARATUS FOR HOT BRIQUETTING OF FERROUS OR NON-FERROUS METALLIC PARTICLES

[75] Inventor: Martin A. Stephens, St. Albans, England

[73] Assignee: Ecobric Foundry Limited, London, England

[21] Appl. No.: 295,538

[22] Filed: Aug. 24, 1981

[30] Foreign Application Priority Data

Nov. 7, 1980 [GB] United Kingdom ..... 8035789

[51] Int. Cl.[3] ..... B30B 11/00; B22F 7/00; B22F 3/12; B27D 7/00

[52] U.S. Cl. ..... 425/78; 425/135; 425/406; 425/407; 432/19; 432/37; 75/0.5 R; 266/81; 266/99; 266/176; 419/30; 419/57

[58] Field of Search ..... 425/78, 135, 406, 407, 425/352; 75/0.5 R, 211, 224; 432/19, 110, 37; 422/10

[56] References Cited

U.S. PATENT DOCUMENTS

| | | | |
|---|---|---|---|
| 3,264,388 | 8/1966 | Roach | 425/78 X |
| 3,303,533 | 2/1967 | King | 425/78 |
| 3,521,326 | 7/1970 | Rice et al. | 425/78 |
| 3,555,597 | 1/1971 | Meodows | 425/407 X |
| 3,704,088 | 11/1972 | Nagel et al. | 75/0.5 R X |
| 3,723,059 | 3/1973 | Thumm et al. | 422/10 |
| 3,732,056 | 5/1973 | Eddy et al. | 425/352 |
| 3,797,986 | 3/1974 | Onder | 425/352 |
| 3,819,311 | 6/1974 | Horn et al. | 425/78 |
| 3,832,107 | 8/1974 | Cox et al. | 425/78 |
| 3,892,506 | 7/1975 | Dann et al. | 425/78 |
| 4,002,421 | 1/1977 | Summer | 432/19 |
| 4,005,956 | 2/1977 | Inoue | 425/78 |
| 4,133,635 | 1/1979 | Fellnor et al. | 432/19 X |
| 4,260,373 | 4/1981 | Fellnor et al. | 432/110 |

*Primary Examiner*—J. Howard Flint, Jr.

*Attorney, Agent, or Firm*—Parmelee, Miller, Welsh & Kratz

[57] ABSTRACT

Hot briquetting apparatus for ferrous or non-ferrous particles has a furnace having upper and lower chambers. The particles are supplied to the lower chamber and leave the lower chamber through a discharge tube to enter a briquetting press. A passage is performed between the lower and upper chambers and sensing means sense the constituents of the gases in that passage. Control means control the air-to-fuel ratio of a zone of the lower chamber. The control means are connected to the output of the sensing means so as to maintain the atmosphere within the zone as a reducing atmosphere, the whole of the lower chamber being a reducing atmosphere.

6 Claims, 3 Drawing Figures

APPARATUS FOR HOT BRIQUETTING OF FERROUS OR NON-FERROUS METALLIC PARTICLES

FIELD OF THE INVENTION

This invention relates to an apparatus for hot briquetting of metallic particles, whether ferrous or non-ferrous.

BACKGROUND OF THE INVENTION

Within the last few years, apparatus has been devised for hot briquetting of metallic particles such as cast iron borings produced when cast iron is machined (such borings are often known as "chips"). In the apparatus the particles are fed to a furnace where they are heated to a temperature which they are plastic but not to the temperature which they melt, the hot particles being discharged from the furnace to a press where they are compacted into briquettes. In the case of cast iron particles, the briquettes thus produced are sold to a manufacturer of cast iron and are normally re-melted in a cupola or an induction or arc furnace to produce foundry castings.

In the furnace any moisture which the particles contain is vapourised and is driven off as steam. Further, any oil which the particles contain also vapourises and is burnt or driven off. The percentage by weight of oil may vary enormously and the combustion of vapourised oil does, of course, require some of the oxygen in the atmosphere in the furnace. The atmosphere in the furnace is desirably a reducing atmosphere in order to prevent oxidisation of the carbon, silicon and manganese in the particles. Attempts have been made to control the air flow to the furnace to ensure that at all times the furnace atmosphere is a reducing atmosphere but difficulties have been encountered in achieving adequate control and some carbon oxidation usually occurs.

In one known apparatus the particles are fed to the lower chamber of a furnace which lower chamber could be decribed as a drier. The furnace contains an upper chamber where combustion of any oil in particles takes place and from which gases are exhausted into a gas stack while the hot particles fall from the lower chamber of the furnace through a discharge chute into the briquetting press.

In this known prior art apparatus there is a manual control to set the fuel to air ratio for high oil and low oil conditions. For the "high oil" condition, that is to say the particles have a high oil content, the air supply is set so as to give a relatively high air to fuel ratio for the burners so that there is sufficient air available to permit combustion of the oil on the particles, i.e. the excess air condition. In the "low oil" condition, it is assumed that the particles have no oil at all and the air to fuel ratio is set to be the stoichiometric condition, that is to say enough air is supplied to the furnace for combustion of all the fuel supplied to the furnace but no excess air is supplied.

Further, with this known apparatus the temperature control within the furnace is carried out at various zones. One zone is the particle inlet to the lower chamber where the burner is located. A second zone is in the lower chamber at the opposite end to the particle inlet where there are two burners jointly controlled.

A third zone is which temperature control is carried out is in the upper chamber where there is provided a further pair of adjacent and cross fired burners approximately in line with the inlet of gases to the upper chamber from the lower chamber which is near to the end of the lower chamber where the particles are fed into that lower chamber. The air flow to the intermediate portion (where there are no burners) of the upper chamber is also temperature controlled; this air flow is jet or secondary air.

From the opposite end of the upper chamber, that is to say, the end of the upper chamber opposite the particle inlet, a gas stack extends and at the base of the gas stack there is a damper to control the ingress of ambient air. There are thus five zones of temperature control, that is to say the first, second and third burner zones, the air flow to the intermediate portion of the upper chamber and the stack. Each of these zones is separately controlled, that is to say adjacent to each of the burners, in the intermediate portion of the upper chamber, and in the stack, there is provided a thermocouple. Each of the burner thermocouples has its output set to control the flow of combustion air to the associated burner(s). In the event that the thermocouple senses a temperature below that desired, the thermocouple controls an associated motorised valve to increase the combustion air. A pressure sensing line is connected between the combustion air flow and the associated fuel inlet of that burner zone so that an increase in combustion air is accompanied by a corresponding increase in fuel, maintaining the fuel to air ratio in that zone constant. The thermocouple is arranged to control the air flow to the intermediate portion of the upper chamber so that a rise in temperature leads to the air flow being increased to reduce the temperature and correspondingly a reverse operation takes place in the event that the thermocouple senses a drop in temperature.

The thermocouple in the stack is set to control the position of the damper at the base of the stack.

In practice, the burners in the upper chamber of the furnace are often found to be unnecessary and is manually switched off. Further, in practice, the thermocouple in the stack always sets the damper at the base of the stack to the position in which it is totally closed.

The "high oil" and "low oil" controls are associated with all three burner zones and when set ensure that the air to fuel ratio for the three burner zones remain constant.

The described apparatus for hot briquetting is intended to maintain a reducing atmosphere in the furnace but this, in practice, is not achieved. U.S. Pat. Nos. 4,133,635 and 4,260,373 refer to apparatus of this type.

SUMMARY OF THE INVENTION

According to this invention there is provided hot briquetting apparatus for ferrous or non-ferrous metallic particles comprising a furnace for heating metallic particles to the plastics range, means for supplying metallic particles to the furnace, sensing means for sensing the constituents of the combustion gases of the furnace, and control means for controlling the air-to-fuel ratio of the furnace, said control means being connected to the output of the sensing means so as to maintain the atmosphere within the furnace as a reducing atmosphere.

Preferably, the furnace comprises a stack for exhausting combustion gases from the furnace, a damper disposed at the bottom of the stack for controlling the ingress of ambient air into the stack, a sensor for sensing the air pressure at the furnace discharge and control means for positioning the damper in accordance with the output of the pressure sensor to maintain the air pressure at the furnace discharge at a desired value.

The sensing means and the control means may be operative in only one part of the furnace.

DESCRIPTION OF THE PREFERRED EMBODIMENT

Figure 1:
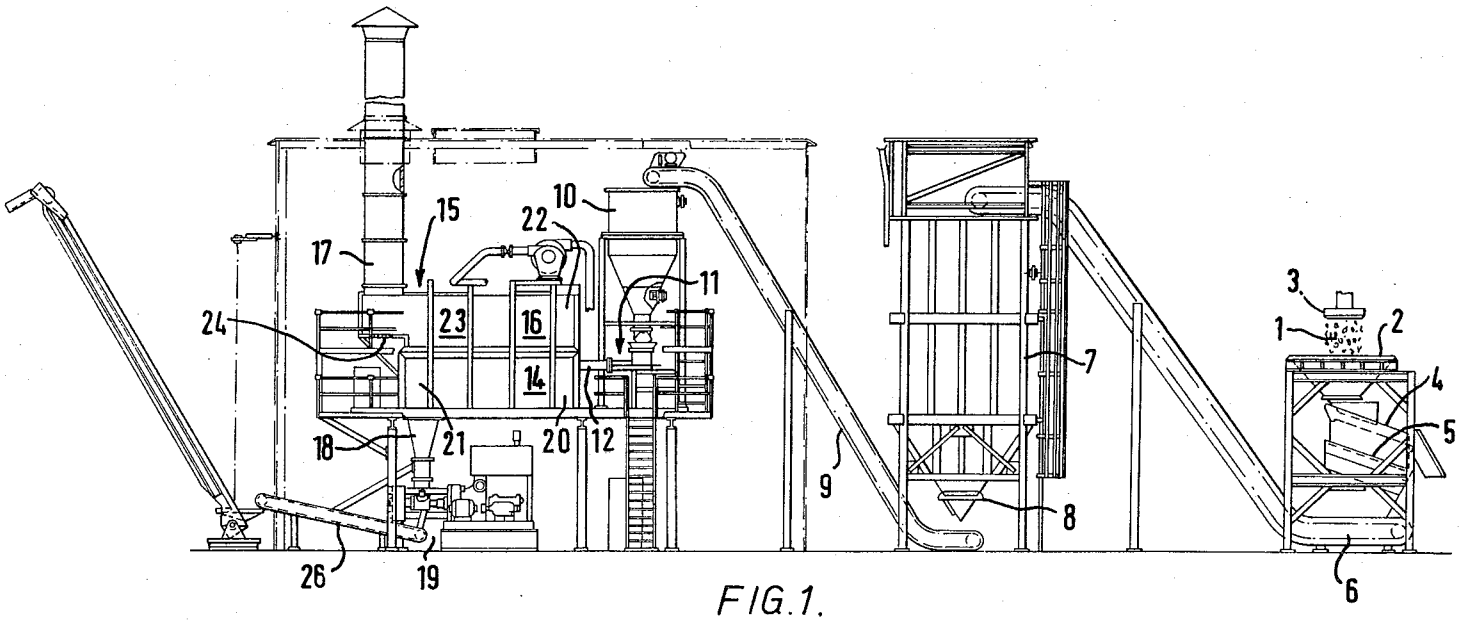
FIG. 1 is a side view showing a general arrangement of the exemplary apparatus for hot briquetting of cast iron particles in accordance with this invention.

Referring to FIG. 1 the particles, e.g. borings 1 are loaded into a loading hopper 2 by a loading crane 3 and fall into a vibratory screen 4 where tramp particles are removed; the chute through which the tramp particles fall off is denoted at 5. The chips 1 leave the vibratory screen 4 by falling onto a conveyor 6 which conveys the particles to a large storage hopper 7. The chips 1 fall-from the hopper 7 through a manually operated feed control gate 8 onto another conveyor 9 which feeds the particles to a small supply hopper 10. The particles are fed out of the bottom of the supply hopper 10 into a screw feeder 11 which comprises a horizontal tube 12 containing an Arechemedian screw driven at a variable speed. The feed tube 12 supplies the particles to the lower chamber 14 of a furnace 15 in which lower chamber the particles are dried. The furnace 15 contains an upper chamber 16 in which combustion of vapourised oil takes place and from which gases are exhausted into a gas stack 17. The dried and heated particles fall from the lower chamber 14 of the furnace 15 through a discharge tube 18 into a briquetting press 19 of conventional construction. The briquettes fall from the press 19 onto an output conveyor 26 and are then supplied to a briquette loading conveyor 21 which feeds them to a store.

In the lower chamber 14 horizontally directed burners are located in burner zones at opposite ends of the chamber 14 where denoted at 20 and 21 and each is associated with a temperature control for controlling the flow of combustion air and fuel to maintain the temperature in its vicinity at a desired value. Zone 20 has one burner whereas zone 21 has two burners disposed side-by-side. In the upper chamber 16 there are disposed a pair of horizontally disposed burners in a zone 22 generally above burner zone 20, the port for gases between the upper and lower chambers 14 and 16 being between the zones 20 and 22. The burners in zone 22 are connected to a control device under the control of a thermocouple in the zone 22, the action of the control being to maintain the temperature in the zone 22 at a desired value. In each of zones 20, 21 and 22 the control device increases the combustion air flow in the event a temperature increase is required. A number of air outlets leading to an air pump are disposed in the zone 23 and a motorized control the flow of air through these outlets into the zone 23 under the control of a thermocouple in the zone 23 again so as to maintain the temperature in the zone 23 at a desired value.

Figure 2:
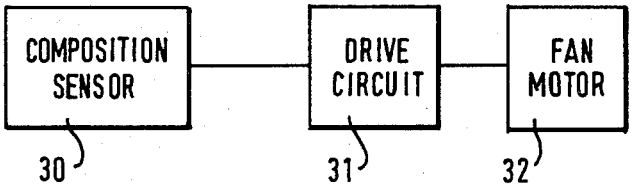
FIG. 2 is a block diagram of part of the apparatus.

The air to fuel ratio of the burner in zone 20 is fixed with the mixture slightly fuel rich and that in the zone 22 is fixed with excess air being provided. The air to fuel ratio of the burners in zone 21 is set by a sensor 30 (FIG. 2) which monitors the constituents of the combustion gases leaving the lower chamber 14 and entering the upper chamber 16. The sensor 30, as shown in FIG. 2, acts through a drive circuit 31 and a fan motor 32 to control the combustion air supply to maintain the atmosphere in the zone 21 always to be a reducing atmosphere. The whole of the lower chamber 14 is thus maintained as a reducing atmosphere.

Figure 3:
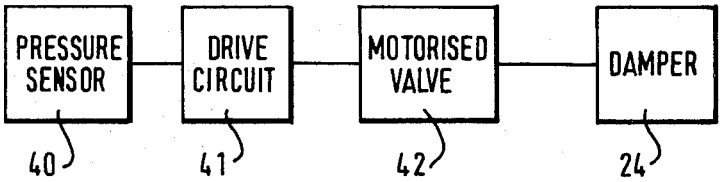
FIG. 3 is a block diagram of another part of the apparatus.

At the base of the stack there is provided a damper 24 controlled by a motorized valve 41 (FIG. 3). The motorised valve is responsive to the output of a pressure sensor 40 which senses the air pressure in the outlet tube 18 and acts through a drive circuit 41 and the motorised valve 42 to position the damper 24 so as to maintain the air pressure in the outlet 18 at a positive value and at a desired value.

Because the air to fuel ratio is controlled at all times in zone 21 the furnace forming part of the hot briquetting apparatus in accordance with this invention is capable of handling particles of cast iron of varying oil content and with the oil content varying rapidly.

What is claimed is:

1. Hot briquetting apparatus for metallic particles comprising a furnace for heating metallic particles to the plastics range, means for supplying metallic particles to the furnace, sensing means for sensing the constituents of the combustion gases of the furnace, control means for controlling the air-to-fuel ratio of the furnace, and a briquetting press which receives heated metal particles from the furnace, said control means being connected to the output of the sensing means so as to maintain the atmosphere within the furnace as a reducing atmosphere.

2. Hot briquetting apparatus as claimed in claim 1,wherein the sensing means and the control means are each operative in only one part of the furnace.

3. Hot briquetting apparatus as claimed in claim 1, wherein the furnace has an upper chamber, a lower chamber, a passage between the upper chamber and the lower chamber, and a discharge aperture leading from the lower chamber to the briquetting press, gases being exhausted in use, from the upper chamber.

4. Hot briquetting apparatus as claimed in claim 2, wherein the furnace has an upper chamber, a lower chamber, a passage between the upper chamber and the lower chamber, and a discharge aperture leading from the lower chamber to the briquetting press, gases being exhausted in use, from the upper chamber.

5. Hot briquetting apparatus as claimed in claim 4, wherein the sensing means senses the constituents of the gases in the said passage and the control means controls the air-to-fuel ratio in all or part of the lower chamber.

6. Hot briquetting apparatus as claimed in any of claims 1 to 3, wherein the furnace comrpises a stack for exhausting combustion gases from the furnace, a damper disposed at the bottom of the stack for controlling the ingress of ambient air into the stack, a sensor for sensing the air pressure at the furnace discharge and control means for positioning the damper in accordance with the output of the pressure sensor to maintain the air pressure at the furnace discharge at a desired value.

* * * * *